US006708544B2

(12) United States Patent
Sannomiya

(10) Patent No.: US 6,708,544 B2
(45) Date of Patent: Mar. 23, 2004

(54) THREAD ROLLING DIE AND PROCESS FOR THE PRODUCTION THEREOF

(75) Inventor: Hitoshi Sannomiya, Gunma (JP)

(73) Assignee: NSK Ltd., Tokyo (JP)

( * ) Notice: Subject to any disclaimer, the term of this patent is extended or adjusted under 35 U.S.C. 154(b) by 25 days.

(21) Appl. No.: 10/075,605

(22) Filed: Feb. 15, 2002

(65) Prior Publication Data

US 2002/0112518 A1 Aug. 22, 2002

(30) Foreign Application Priority Data

Feb. 16, 2001 (JP) ..... P. 2001-040625

(51) Int. Cl.[7] ..... B21H 3/04

(52) U.S. Cl. ..... 72/103; 72/98; 72/118; 470/10; 470/185

(58) Field of Search ..... 72/98, 103, 104, 72/118; 470/10, 66, 70, 71, 185

(56) References Cited

U.S. PATENT DOCUMENTS 2,720,801 A * 10/1955 Erdelyi et al. ..... 72/103
2,937,547 A * 5/1960 Moeltzner ..... 72/103
3,023,546 A 3/1962 Beck
3,651,678 A * 3/1972 Zook et al. ..... 72/103
3,942,349 A * 3/1976 Williams et al. ..... 72/98
4,666,348 A * 5/1987 Corrette ..... 72/88
5,937,684 A * 8/1999 Long ..... 72/118

FOREIGN PATENT DOCUMENTS

JP 9-133195 5/1997
SU 1433604 * 10/1988 ..... 72/103

* cited by examiner

*Primary Examiner*—Ed Tolan
(74) *Attorney, Agent, or Firm*—Sughrue Mion, PLLC

(57) ABSTRACT

In a rolling die for forming a ball screw by rolling for example, a biting portion is formed on one end of a straight portion while a relief portion is formed on the other end. Further, the helical protrusion on the biting portion and the helical protrusion on the relief portion each become continuously and gradually smaller as distancing away from the dancette portion on the straight portion. The dancette portion on the various portions are continuously formed using only one grinding wheel with its grinding lead being changed.

8 Claims, 8 Drawing Sheets

THREAD ROLLING DIE AND PROCESS FOR THE PRODUCTION THEREOF

BACKGROUND OF THE INVENTION

The present invention relates to a thread rolling die and a process for the production thereof.

Formation of grooves in, e.g., ball screw shaft can be accomplished by rolling or grinding. The former process is used to produce a general-purpose ball screw, while the latter process is used to produce a precision ball screw. The formation of grooves for rolled ball screw can be accomplished by a process of transferring shape of over two or three roll dies (hereinafter referred to as "rolling die"). Thus the formation of grooves by the process of transferring gives a higher productivity than grinding. The rolling process enables mass production at a reduced cost according to standard specification.

An example of the conventional die is disclosed in JP-A-9-133195. As shown in FIG. 6, a rolling die 1 comprises a cylindrical portion 2, and conical portions 3, 3' which are connected with the cylindrical portion 2 at both ends thereof and diameter of which each become smaller towards the respective outer end thereof. A helical protrusion (dancette portion) for rolling 8 is continuously formed over the area ranging from one conical portion 3 to the other conical portion 3' through the cylindrical portion 2. A face connecting the crowning of the helical protrusion 8 on the cylindrical portion 2 forms a cylindrical side face 6 along the periphery of the cylindrical portion so as to give a straight portion S. Faces connecting the crowning of the helical protrusion on the conical portions 3, 3', each form conical side faces 7, 7' along the inclined surface of the conical portions. The conical side surface 7 forms a predetermined angle θ (from 220 to 15°) of inclination with respect to the cylindrical side face 6 in order to form a biting portion K. On the other hand, the conical side surface 7' forms a predetermined angle θ' (from 2° to 90°) of inclination with respect to the cylindrical side face 6 to form a relief portion N.

In the case where this conventional rolling die is used to form a thread in a ball screw shaft by rolling, the lead angle of the rolling die 1 and a lead angle of a rod material are each deviated by a predetermined value, when the rolling die 1 is pressed against the rod material. In this manner, the rolling die 1 and the rod material come into relative rotation as well as walking phenomenon. As a result, the rolling die 1 and the rod material automatically come into rolling while making relative movement in their axial direction (longitudinal direction). During rolling, the rolling die 1 relative moves toward the side of its biting portion K. Since a threaded groove is formed in the rod material with respect to gradually increasing of the amount of biting by the rolling die 1 which is according to the magnitude of the angle θ of inclination, the resistance during rolling can be lowered.

The process, which comprises forming thread while giving a longitudinal feed by the walking phenomenon developed by deviation of the lead angle of the rolling die and the rod material, is referred to as "through-rolling", and this process has heretofore been widely practiced.

Thus, in the conventional rolling die, longitudinally sectional shapes of helical protrusions (dancette portion) on the tapered biting portion K and relief portion N are different from that of the untapered straight portion S. In order to produce the conventional rolling die by grinding, different grinding wheels must be used to grind the straight portion S, and to grind the biting portion K and the relief portion N.

FIG. 7 shows an example of the conventional process for the production of a rolling die. A grinding wheel A is used to grind the straight portion S of the rolling die 1. Another grinding wheel B is used to grind the biting portion K. A further grinding wheel C is used to grind the relief portion N, which is oblique in the direction opposite the biting portion K. Thus, the grinding wheels are exchanged at every portion. Grinding is independently effected while the axial position being controlled.

In the case of the conventional rolling die, however, the dancette portions on the biting portion K, the straight portion S and the relief portion N formed by different grinding wheels can easily have different shapes. In addition the connection between these portions difficulty have desired precision in working. Therefore, the conventional rolling die is disadvantageous in that (i) the connection between the various portions has an edge and (ii) the use of a plurality of grinding wheels A, B and C adds to cost. Further, every time the angle θ of inclination of the biting portion K and the angle θ' of inclination of the relief portion N differ from each other, another grinding wheel must be accordingly prepared. Thus, it is not practical from the standpoint of cost and precision to provide the biting portion K with a plurality of different angles of inclination. Moreover, it is impossible to provide the biting portion K with a continuous change of these angles of inclinations.

In recent years, there has been growing a demand for a rolled-ball screw which can be produced at a high productivity but has the same performance as in the precision ball screw produced by grinding. However, it is likely that the ball screw, which is produced by rolling with the use of a conventional rolling die having a poor precision in transfer of dancette portion and in connection between the various portions, cannot meet severe requirements such as improvement of precision in positioning, improvement of life and reduction of noise.

Further, when a conventional rolling die having an edge on the connection between various portions is used to produce a ball screw, stress is concentrated onto the edge portion, an adverse effect is given on the precision in shape of threaded groove in the ball screw.

Moreover, when a through-rolling die is used, the magnitude of angle θ of inclination of the biting portion K gives an adverse effect on the precision in threaded groove in the ball screw shaft. In order to improve the precision, the angle θ of inclination of the rolling die may be reduced (excessive reduction of the angle θ of inclination is not good). However, this requires a die having too long a width that adds to production cost. Further, rolling requires increased pressing force that requires a large-scale apparatus.

SUMMARY OF THE INVENTION

Accordingly, the present invention has been worked out paying attention to the unresolved problems of the related art. It is an object of the present invention to provide a thread rolling die which can form a threaded groove in a screw shaft by rolling at a reduced cost with a high precision. It is also an object of the present invention to provide a die producing process which can produce biting portion, straight portion and relief portion of the rolling die using the same die grinding wheel at a reduced cost.

A second object of the present invention is to provide a rolling die for ball screw which can form a high precision threaded groove on the periphery of a ball screw material by rolling.

A third object of the present invention is to provide a ball screw which can enhance the precision in positioning and reduce noise.

In order to accomplish the foregoing objects, a first aspect of the present invention is a rolling die for thread through-rolling comprising a dancette portion formed helically continuously on the periphery thereof, wherein the dancette portion becomes smaller away from a central portion to at least one end in a longitudinal direction thereof.

A second aspect of the present invention is a rolling die for ball screw comprising a straight portion formed on a central portion and having the same shaped dancette portion, a biting portion formed at one end of the straight portion in the longitudinal direction and having a helical protrusion, and a relief portion formed on the other end of the straight portion in the longitudinal direction and having a helical protrusion, wherein the helical protrusions formed on the biting portion and the relief portion each become continuously and gradually smaller away from the dancette portion on the straight portion.

A third aspect of the present invention is a process for the production of the rolling die for ball screw defined in the second aspect, comprising the steps of grinding forming the dancette portion on the straight portion of the die with uniform lead of working of a grinding wheel, forming one side of the dancette portion on each of the biting portion and the relief portion with the grinding wheel in such a manner that lead of working is changed to be greater than that at the straight portion as distancing away from the straight portion and continuously increases without changing the radial position of the grinding wheel and forming the other side of the dancette portion on each of the biting portion and the relief portion with the same grinding wheel in such a manner that lead of working is changed to be smaller than that at the straight portion as distancing away from the straight portion and continuously decreasing without changing the radial position of the grinding wheel; wherein the forming of the dancette portion on the straight portion, the biting portion and the relief portion is continuously performed.

A forth aspect of the present invention is the rolling die for ball screw comprising a straight portion formed on a central portion and having the same shaped dancette portion and a biting portion formed at one end of the straight portion in the longitudinal direction and having a helical protrusion, wherein the helical protrusion on the biting portion becomes continuously and gradually smaller away from the dancette portion on the straight portion.

A fifth aspect of the present invention is a ball screw having a ball threaded groove formed by rolling by the rolling die defined in the first, second and fifth aspects.

DESCRIPTION OF THE PREFERRED EMBDIMENTS

Embodiments of implication of the present invention will be described hereinafter in connection with the attached drawings.

Figure 1:
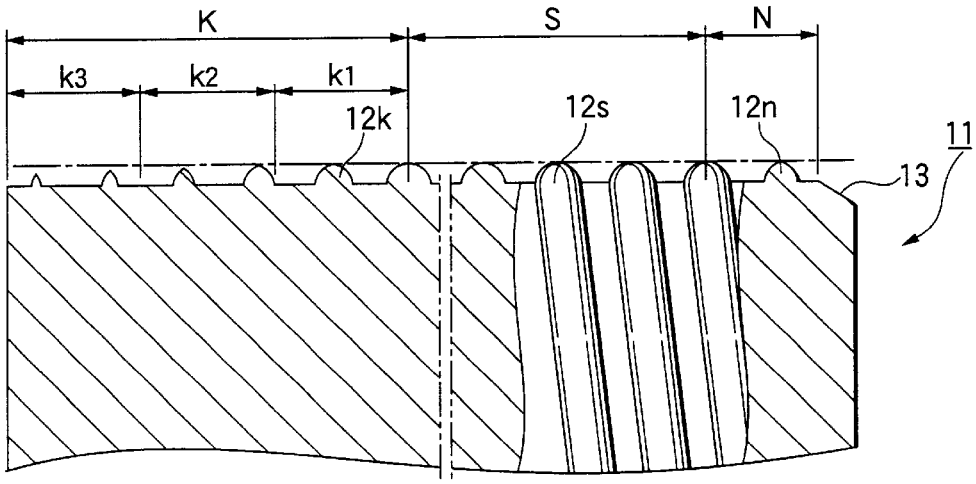
FIG. 1 is a sectional view illustrating an embodiment of the thread rolling die of the present invention.

FIG. 1 is a general sectional view (partly shown by external shape) of a rolling die for ball screw as an embodiment of a rolling die of the present invention. A rolling die 11 is generally a cylindrical roll having a helical protrusion 12. The helical protrusion 12 has a mountain-shaped section, as a dancette portion, formed continuously at a constant lead over substantially all the longitudinal length thereof on the periphery thereof. In operation, the rolling die performs through-rolling on a rod material of ball screw (work W) to form a specified ball thread groove therein.

The die 11 has a helical protrusion 12*s* comprising a continuity of mountains. Each of the mountains has the same shape and dimension on the straight portion S disposed at the center of the die 11. The shape of the helical protrusion 12*s* is transferred to the threaded groove in the finished ball screw shaft. In FIG. 1, on the left of the straight portion S (side of the direction of relative movement of the rolling die 11 with respect to the rod material), a biting portion K is shown. A helical protrusion 12*k* which becomes continuously and gradually smaller away from the helical protrusion 12*s* is formed on the biting portion K by several turns. On the other hand, on the right of the straight portion S, a relief portion N is shown. A helical protrusion 12*n* which becomes continuously and gradually smaller away from the helical protrusion 12*s* is formed on the relief portion N by approximately one turn. Further, the corner of the end of the rod material on the helical protrusion 12*n* is cut away obliquely to form a screw outer diameter relief portion 13. The connection between the biting portion K and the straight portion S and between the straight portion S and the relief portion N have little or no difference in level. In this arrangement, the biting portion K, the straight portion S and the relief portion N form a smooth continuity.

The biting portion K comprises a rough rolling portion $k_3$ which bites deeply in the outer surface of the rod material at the beginning of the through-rolling, a middle rolling portion $k_2$ which subsequently bites slightly deeply in the rod material and a finish rolling portion $k_1$ connected to the straight portion S which finally bites less deeply in the rod material.

A process (grinding process) for the production of a thread rolling die of the present invention having such an arrangement will be described hereinafter.

Figure 2:
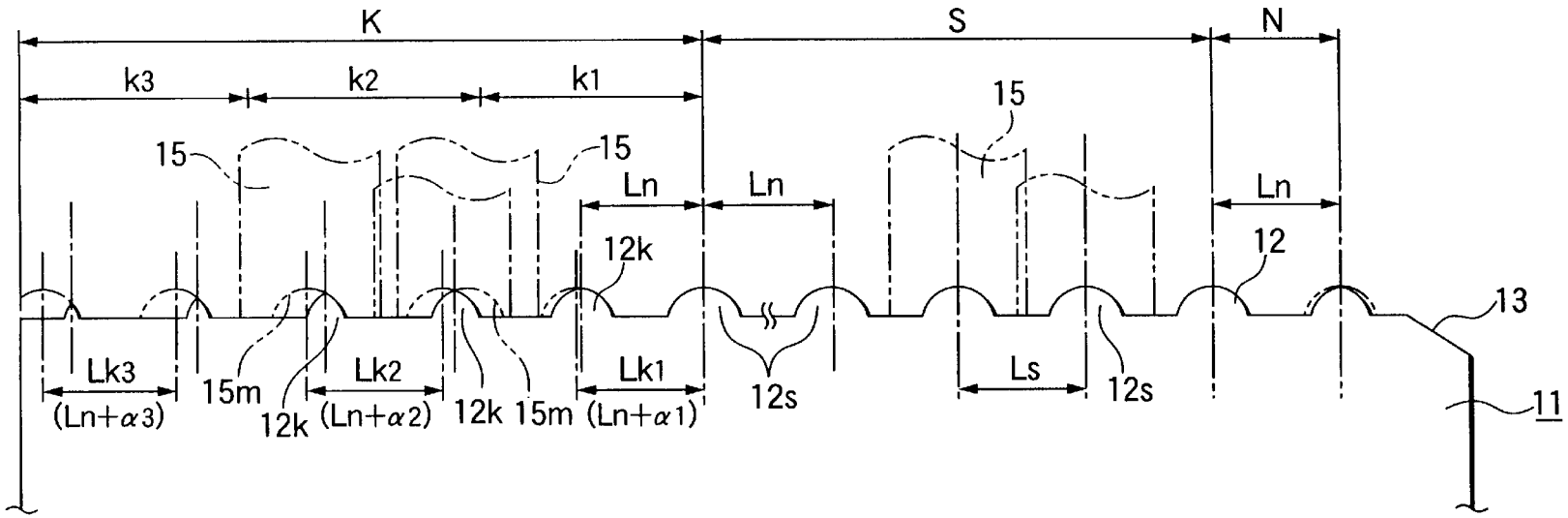
FIG. 2 is a schematic diagram illustrating an embodiment of the process for the production of the thread rolling die of FIG. 1.

There are two working processes for grinding a die material having a helical protrusion previously formed thereon with a die grinding wheel to be used which depends on the different grinding wheels. As shown in FIG. 2, one of the two processes involves the use of a grinding wheel 15 for grinding the mountains on the die 11 having a substantially semi-arc groove (Gothic arch-like groove) formed by one turn at the center of the crosswise section thereof. This production process will be hereinafter referred to as "die forming process 1".

In accordance with the process 1 for forming rolling die of the present invention, the biting portion K, the straight portion S and the relief portion N of the rolling die 11 are all ground by only the same grinding wheel 15. However, the grinding lead L of the grinding wheel 15 differs from one portion to the other portion. In other words, the grinding of the helical protrusion 12*k* on the biting portion K having the same thread lead Ln as that of the helical protrusion 12*s* on the straight portion S but continuously and gradually decreasing mountain size is conducted following the grinding of the straight portion S. The grinding wheel 15 is used also for the biting portion K. During this procedure, the grinding wheel 15 is continuously moved in the axial direction with a continuous and gradual increase of the grinding lead Lk without changing the axial position.

In other words, the finish rolling portion $k_1$ on the biting portion K is ground with a continuous and gradual increase of the grinding lead. For example, the finish rolling portion $k_1$ on the biting portion K is ground by moving the grinding wheel 15 first at a grinding lead $LK_1$, of slightly greater (plus $\alpha_1$) than the grinding lead Ls of the straight portion S, at a grinding lead $Lk_2$ of slightly more greater (plus $\alpha_2$) than the grinding lead Ls of the straight portion S at the following middle rolling portion $k_2$ and then at a grinding lead $Lk_3$ of slightly even more greater (plus $\alpha_3$) than the grinding lead Ls of the straight portion S at the rough rolling portion $k_3$ on the forward end thereof. In this manner, one side (right side) of the helical protrusion 12*k* on the biting portion K of the rolling die 11 is ground by the shoulder of the groove 15*m* of the grinding wheel Once the grinding of the biting portion K has been conducted beginning with the finish rolling portion $k_1$ and ending with the rough rolling portion $k_3$ at a grinding lead $Lk_1$ to $Lk_3$ which gradually increases from the grinding lead Ls of the straight portion S. The grinding of the rolling portion K is conducted again beginning with the finish rolling portion $k_1$ and ending with the rough rolling portion $k_3$ by moving the grinding wheel 15 at a grinding lead $Lk_1$ to $Lk_3$ which gradually decreases as opposed to the first time grinding. During the second grinding procedure, the other side (left side) of the helical protrusion 12*k* is ground by the other shoulder of the groove 15*m* of the grinding wheel. Of course, the time of grinding operations is not limited to one. If necessary, grinding may be conducted a plurality of times at different grinding leads. In this manner, the helical protrusion 12*k* on the finish rolling portion K, which becomes gradually smaller in the direction of relative movement of the rolling die 11, can be ground continuously by the same grinding wheel 15. By conducting the grinding of the rolling portion following the straight portion S, the precision in connection can be enhanced.

Similarly, the grinding of the relief portion N of the rolling die 11 may be carried out by moving the grinding wheel 15 at a grinding lead of slightly greater than that at the straight portion S and at a grinding lead of slightly smaller than that at the straight portion S.

A forming process 2 which is the other process for forming a thread rolling die will be described hereinafter.

Figure 3:
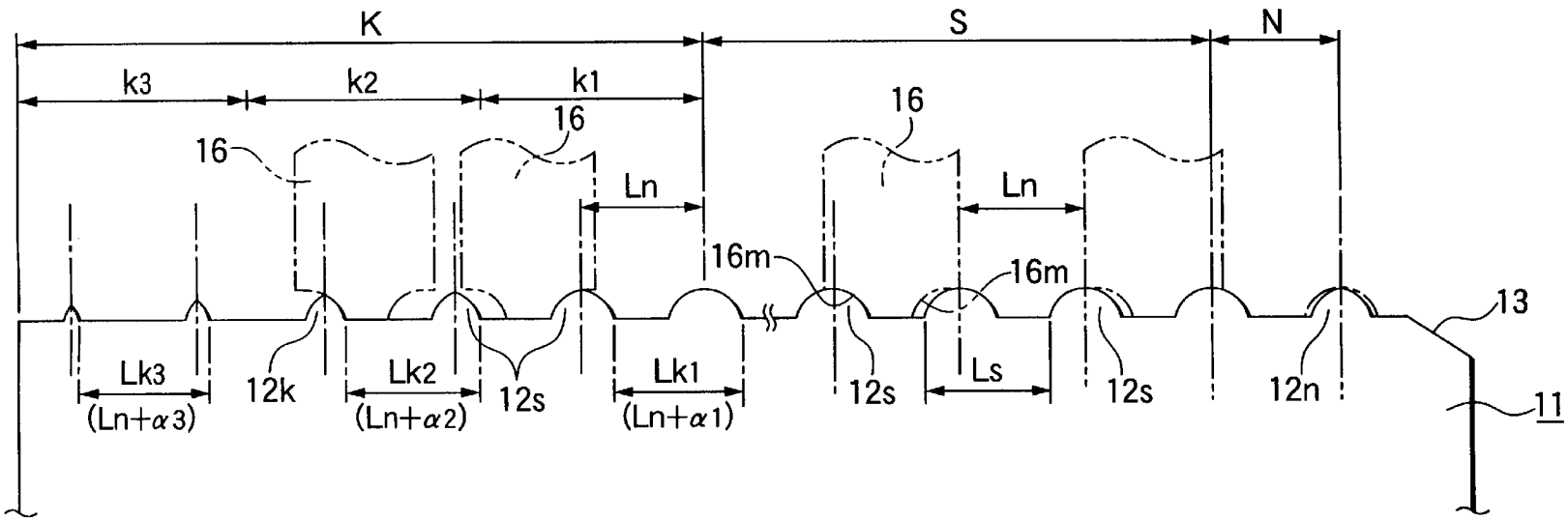
FIG. 3 is a schematic diagram illustrating another embodiment of the process for the production of the thread rolling die of FIG. 1.

In accordance with the forming process 2, the shape of the grinding wheel 16 is different from that of the foregoing grinding wheel 15 as shown in FIG. 3. In other words, the grinding wheel 16 has a pair of quarter-arc grooves 16*m* formed on the respective edge formed by the side wall and the lower surface thereof.

Similarly to the forming process 1, the helical protrusion 12 is ground successively on both sides thereof using only the same grinding wheel 16 on the biting portion K, the straight portion S and the relief portion N of the rolling die 11 at a grinding lead differing from one portion to the other portion. In this manner, the helical protrusion 12*k* on the finish rolling portion K, which becomes gradually smaller in the direction of relative movement of the rolling die 11, can be continuously ground by the same grinding wheel 16 as that used for the straight portion S. The grinding of the relief portion N of the rolling die 11 can be conducted similarly to the forming process 1.

In accordance with the foregoing thread rolling die 11 and its production process, regardless of whichever is used the forming process 1 or the forming process 2, the biting portion K, the straight portion S and the relief portion N can be continuously ground by the same grinding wheel, making it possible to not only reduce the production cost but also obtain the following many effects.

(i) Since grinding is conducted by only one grinding wheel while the movement of the grinding wheel is being controlled, the resulting rolling die 11 has a good precision in the shape of the helical protrusion 12, a good precision in the connection between the biting portion K and the straight portion S and between the straight portion S and the relief portion N and a definite difference in lead between the biting portion K and the straight portion S and between the straight portion S and the relief portion N. Accordingly, the threaded groove produced by rolling by the rolling die 11 from the work W as the material to be rolled can have an assured precision in shape and staggering in the direction of running along the threaded groove (precision in lead). Thus, a ball screw which can easily meet severe requirements for positioning precision, life, noise resistance, etc. can be provided.

(ii) Since the connection between the biting portion K and the straight portion S and between the straight portion S and the relief portion N is extremely smooth and has no edge, no concentration of stress occurs as opposed to the conventional case when a threaded groove is formed in the work W by rolling, preventing the deformation of the threaded groove. In this respect, too, the resulting threaded groove can be provided with desired precision in shape.

(iii) Since the time required to form and align the groove in the grinding wheel at the grinding step during the production of die can be reduced or omitted as compared with the conventional case, the cost of producing die can be reduced.

(iv) Since the production of die requires no use of a plurality of grinding wheels corresponding to a plurality of shapes of groove as opposed to the conventional case and a die having a wider width than the conventional case can be designed, the cost of producing rolling die can be reduced.

(v) For the thread rolling die having a biting portion K comprising a rough rolling portion $k_3$, a middle rolling portion $k_2$ and a finish rolling portion $k_1$, the adjustment of the amount of rolling per rotation of the work W, which has heretofore been made impossible, can be made. In this arrangement, by predetermining the degree of change of grinding lead in the finish rolling range of the rolling die to be small and predetermining the degree of change of grinding lead in the rough rolling range of the rolling die to be great, rolling can be realized with both desired precision and efficiency. Further, by continuously changing the grinding lead, the amount of rolling per rotation of the work can be adjusted more closely.

Figure 8:
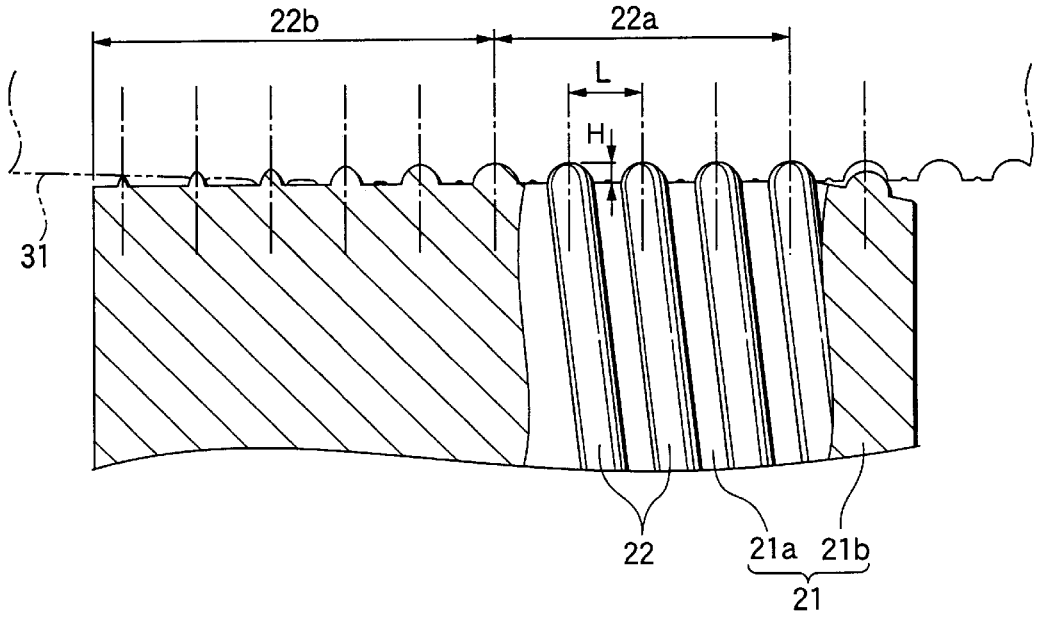
FIG. 8 is a sectional view illustrating a second embodiment of the thread rolling die according to the present invention.
Figure 9:
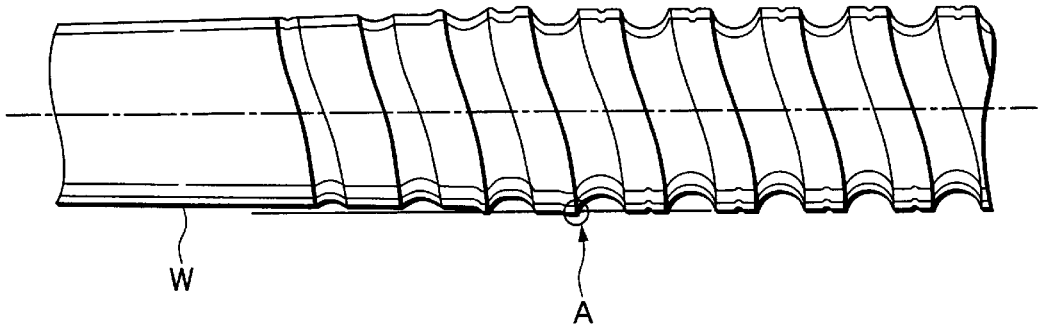
FIG. 9 is a diagram illustrating the threaded groove formed by rolling by a conventional rolling die.
Figure 10:
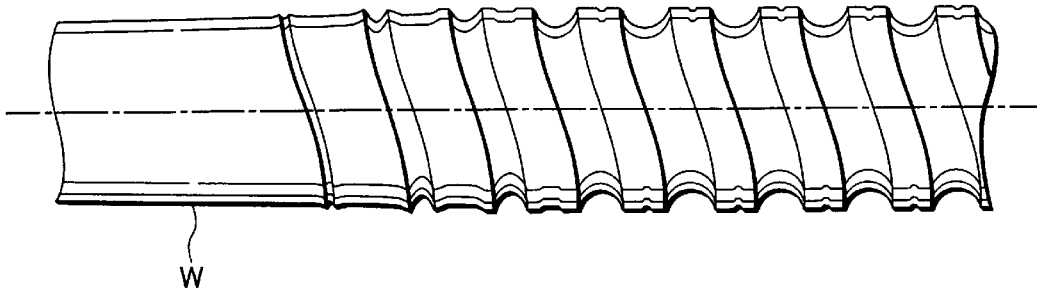
FIG. 10 is a diagram illustrating the threaded groove formed by rolling by a rolling die according to the present invention.

(vi) In the case where rolling is conducted by means of a rolling die having an inclination on the biting portion as in the conventional case, a portion A having a diameter of greater than the outer diameter of the work W (material to be rolled) to be rolled occurs at some points during rolling as shown in FIG. 9. In the present invention, on the contrary, the dancette portion can be crushed by the cylindrical portion X of the die (see FIG. 8). Thus, as shown in FIG. 10, no portion having a diameter of greater than the outer diameter of the thread of the work (material to be rolled) w can occur during rolling. Accordingly, a thread having a specification capable of rolling the work W over the end to the middle point thereof can be used to produce a screw the outer diameter of which is not partly greater than the outer diameter of the thread of the work W.

Figure 5:
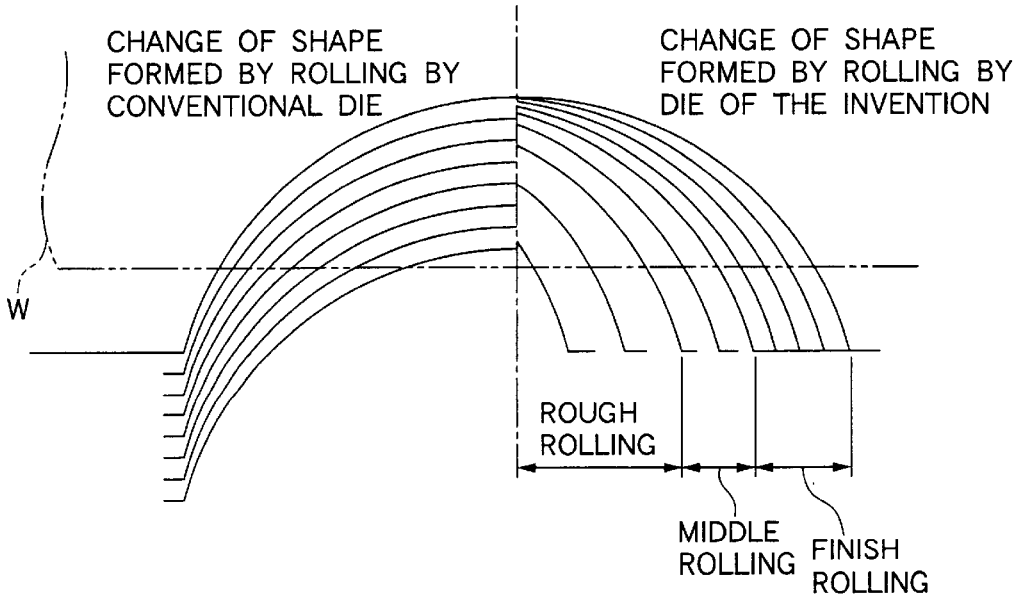
FIG. 5 is a diagram illustrating how the sectional shape of the groove formed by rolling by the biting portion of the die during the formation of thread in the work W by rolling by the rolling die changes as compared with the conventional case.
Figure 6:
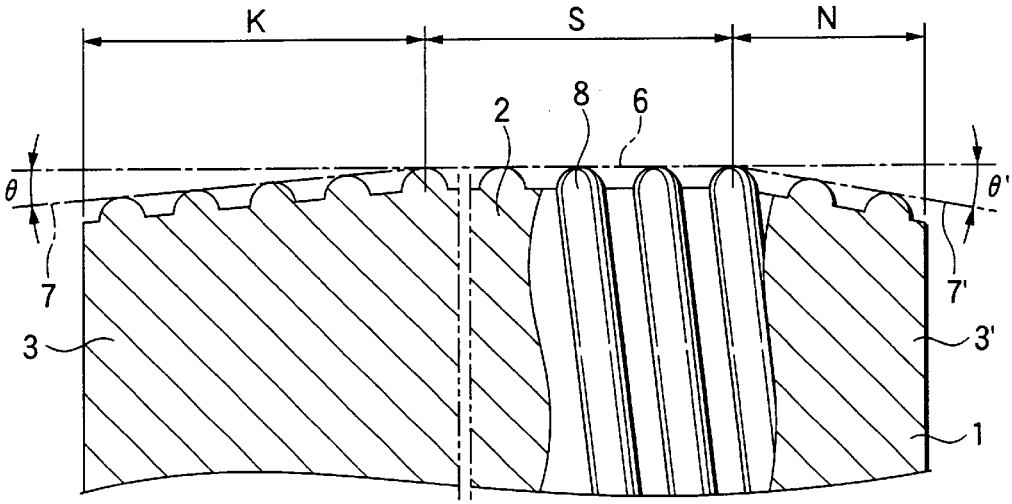
FIG. 6 is a sectional view illustrating an example of the conventional thread rolling die.
Figure 7:
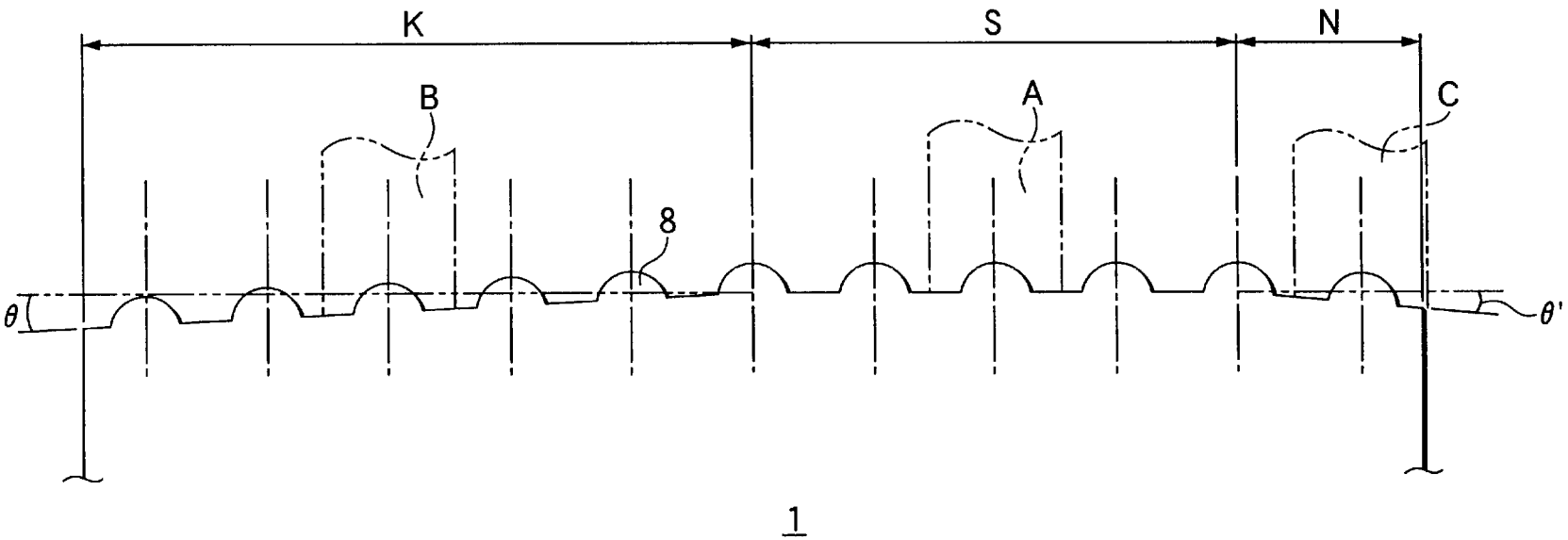
FIG. 7 is a schematic diagram illustrating an example of the conventional process for the production of thread rolling die.

(vii) In the case where the conventional die is used, the resulting finished area has much deformation at the bottom of the threaded groove and little deformation at the shoulder of the threaded groove (see FIG. 5). This requires that the material at the bottom of the threaded groove is driven close to the shoulder of the threaded groove. This further requires a great rolling load and rolling torque (torque for rotating die) during rolling. In the present embodiment, on the contrary, the resulting finished area has little deformation at the bottom of the threaded groove and much deformation at the shoulder of the threaded groove (see FIG. 5). In this arrangement, the flow of the material during plastic formation is smooth, eliminating the necessity of a great rolling load or rolling torque during rolling.

(viii) In the case where the conventional die is used, the transferred shape of groove shows a great change with the change of plastic deformation (change of extrusion by die). Further, since a pair of threads (right and left sides) cannot be uniformly transferred, it is made difficult to produce a rolled ball screw having a high precision in shape of groove. In the present embodiment, on the contrary, the flow of the material can be fairly conducted, giving little change of shape of groove even with the change of plastic deformation and making it possible to uniformly transfer the pair of threaded grooves. In this manner, a rolled ball screw having an invariably high precision in shape of groove can be produced.

Figure 4:
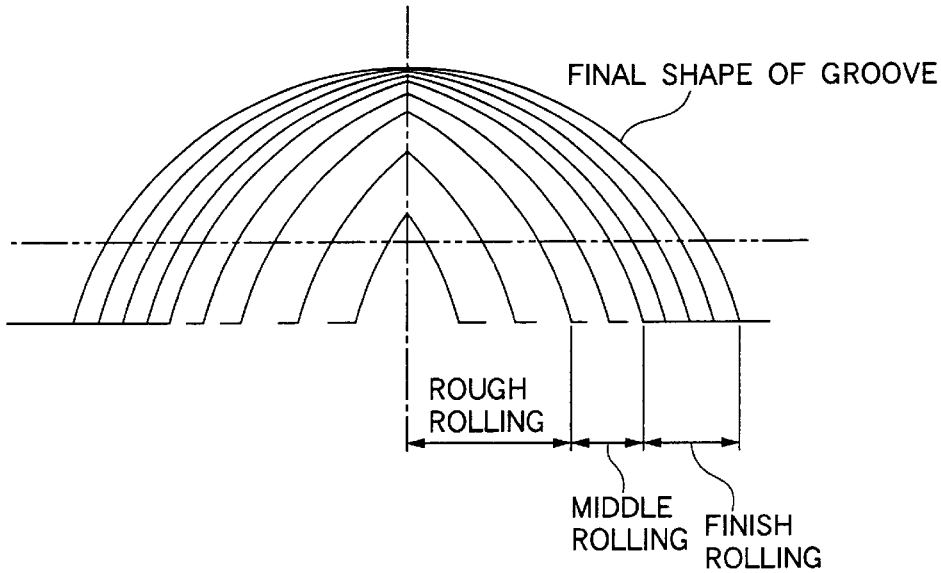
FIG. 4 is a schematic diagram illustrating the sectional shape of helical protrusion 12*s* formed by grinding on a rough rolling portion $k_3$ a middle rolling portion $k_2$ and a finish rolling portion $k_1$, on the biting portion K of the thread rolling die of FIG. 1.

FIG. 4 illustrates the section of the ground helical protrusion 12*s* on the rough rolling portion $k_3$, the middle rolling portion $k_2$ and the finish rolling portion $k_1$ of the biting portion K of the rolling die 11 according to the first embodiment of implication of the present invention as viewed overlapped. The outermost periphery is the final shape of the finish rolling portion $k_1$.

FIG. 5 illustrates how the shape of the section of the groove formed by rolling by the biting portion of the die changes during the formation of threaded groove in the work W by a rolling die. The left half of the diagram illustrates the change of shape formed by rolling by a conventional die, while the right half of the diagram illustrates the change of shape formed by rolling by a die according to the present invention.

A second embodiment of the rolling die according to the present invention will be described hereinafter.

FIG. 8 is a diagram illustrating the second embodiment of the rolling die according to the present invention. In FIG. 8, a rolling die 20 for ball screw is formed by a main die body (roll) 21 comprising a cylindrical portion 21*a* and a conical relief portion 21*b* formed at one end of the cylindrical portion 21*a*. The main die body 21 comprises a helical protrusion (dancette portion) 22 formed continuously on the periphery thereof over one end to the other thereof.

The helical protrusion 22 comprises a portion 22*a* having a constant height (hereinafter referred to as "straight portion") and a portion 22*b* having different heights (hereinafter referred to as "biting portion"). The biting portion 22*b* is formed at one end of the main die body 21 which is opposite the relief portion 21*b*. The second embodiment is the same as the first embodiment in that only the biting portion 22*b* has a helical protrusion which becomes continuously smaller away from the straight portion. However, the second embodiment is different from the first embodiment in that the lead of the grinding wheel changes once over the entire range of the biting portion 22*b* and the dancette portion on the relief portion 21*b* is the same as in the relief portion of the conventional rolling die.

The present invention can be applied to rolled screws other than ball screw.

The process for the formation of rolling die is not limited to grinding. All removing processes such as grinding with forming tool can be employed.

As mentioned above, the present invention according to the first aspect can provide a rolling die for thread through-rolling which can form a threaded groove in a screw shaft by rolling at a reduced cost with a high precision.

The present invention according to the second aspect can provide a rolling die for ball screw which can form a threaded groove in a ball screw material by rolling at a reduced cost with a high precision.

The present invention according to the third aspect can produce a thread rolling die comprising a biting portion, a straight portion and a relief portion using the same die grinding wheel at a reduced cost.

The present invention according to the forth aspect, too, can exert the same effect as by the present invention according to the first aspect.

The present invention according to the fifth aspect can enhance the precision in positioning of ball screw and reduce noise.

What is claimed is:

1. A rolling die for thread through-rolling comprising:

a body; and a dancette portion formed continuously on a periphery of the body, wherein the dancette portion comprises a helical protrusion that becomes smaller in thickness as it extends away from a central portion to at least one end in a longitudinal direction of the body, wherein the thickness is measured in a direction parallel to a periphery of the body as viewed in a cross-section extending in the longitudinal direction of the body.

2. A ball screw having a ball threaded groove formed by rolling by the rolling die defined in claim 1.

3. A rolling die for ball screw comprising:

a body;

a straight portion formed on a central portion of the body and having a uniformly shaped dancette portion;

a biting portion formed at one end of the straight portion in the longitudinal direction and having a dancette portion; and a relief portion formed on the other end of the straight portion in the longitudinal direction and having a dancette portion, wherein the dancette portions formed on the biting portion and the relief portion each comprises a helical protrusion that becomes continuously and gradually smaller in thickness as it extends away from the dancette portion on the straight portion, wherein the thickness is measured in a direction parallel to a periphery of the body as viewed in a cross-section extending in the longitudinal direction of the body.

4. A process for the production of the rolling die for ball screw defined in claim 3, comprising the steps of:

grinding forming the dancette portion on the straight portion of the die with a uniform lead of a grinding wheel;

forming one side of the dancette portion on each of the biting portion and the relief portion with the grinding wheel in such a manner that the lead of the grinding wheel is increased with respect to that at the straight portion in a direction moving away from the straight portion and continuously increases without changing the radial position of the grinding wheel; and forming the other side of the dancette portion on each of the biting portion and the relief portion with the same grinding wheel in such a manner that the lead of the grinding wheel is decreased with respect to that at the straight portion in a direction moving away from the straight portion and continuously decreases without changing the radial position of the grinding wheel.

5. The process for the production of the rolling die as set forth in claim 4, wherein the forming of the dancette portion on the straight portion, the biting portion and the relief portion is continuously performed.

6. A ball screw having a ball threaded groove formed by rolling with the rolling die defined in claim 3.

7. The rolling die for ball screw comprising:

a body;

a straight portion formed on a central portion of the body and having a uniformly shaped dancette portion; and a biting portion formed at one end of the straight portion in the longitudinal direction and having a dancette portion, wherein the dancette portion on the biting portion comprises a helical protrusion that becomes continuously and gradually smaller in thickness as it extends away from the dancette portion on the straight portion, wherein the thickness is measured in a direction parallel to a periphery of the body as viewed in a cross-section extending in the longitudinal direction of the body.

8. A ball screw having a ball threaded groove formed by rolling with the rolling die defined in claim 7.

* * * * *